US008691162B1

(12) United States Patent
Lin et al.

(10) Patent No.: US 8,691,162 B1
(45) Date of Patent: Apr. 8, 2014

(54) BIOMEDICAL DIAGNOSTIC DEVICE

(71) Applicant: National Tsing Hua University, Hsin Chu (TW)

(72) Inventors: Shang-Chi Lin, Hsinchu (TW); Li-Ching Chen, Hsinchu (TW); Chen-Meng Kuan, Hsinchu (TW); Fan-Gang Tseng, Hsinchu (TW); Chao-Min Cheng, New Taipei (TW)

(73) Assignee: National Tsing Hua University, Hsin Chu (TW)

( * ) Notice: Subject to any disclaimer, the term of this patent is extended or adjusted under 35 U.S.C. 154(b) by 18 days.

(21) Appl. No.: 13/762,026

(22) Filed: Feb. 7, 2013

(30) Foreign Application Priority Data

Nov. 5, 2012 (TW) ..... 101141058 A

(51) Int. Cl.
*B01L 3/00* (2006.01)

(52) U.S. Cl.
USPC ..... 422/421; 422/401; 422/402; 422/408

(58) Field of Classification Search
USPC ..... 422/401, 402, 408, 421
See application file for complete search history.

(56) References Cited

U.S. PATENT DOCUMENTS

2005/0196747 A1* 9/2005 Stiene ..... 435/4
2005/0230252 A1* 10/2005 Tsai et al. ..... 204/450

* cited by examiner

*Primary Examiner* — Monique Cole
(74) *Attorney, Agent, or Firm* — Muncy, Geissler, Olds & Lowe, PLLC

(57) ABSTRACT

A biomedical diagnostic device includes a hydrophilic layer, hydrophobic layer, and at least one test pad. The hydrophilic layer includes an exposed introductory portion adapted to introduce a test fluid, and is stacked with the hydrophobic layer with multiple access holes. At least one test pad, each of which includes a distinguishing reaction medium, is disposed in the corresponding holes that extend to contact the hydrophilic layer. The relations within the device are as follows: hydrophilicity of any of the test pads>hydrophilicity of the hydrophilic layer>hydrophilicity of the hydrophobic layer.

10 Claims, 7 Drawing Sheets

BIOMEDICAL DIAGNOSTIC DEVICE

FIELD OF THE INVENTION

The invention is relevant to a biomedical diagnostic device, specifically a biomedical diagnostic device of rather simplified structure and low manufacturing cost capable of simultaneously detecting multiple biomarkers.

DESCRIPTION OF THE PRIOR ART

Health is a central issue in human life, especially given that various diseases are associated with increased civilization and economic growth. The concept of disease prevention is already widely accepted by the public, and timely diagnosis is one way to achieve this. Traditionally, disease prevention requires significant manpower, materials, effort, instruments, time, and even expenditure to determine the occurrence of a disease in a timely manner, and time, and even timely diagnosis can be costly since only institutions such as large hospitals offer diagnostic services.

Disease diagnoses can be categorized into in vivo and in vitro types, where the latter have become a main development trend owing to their low risk, convenience, and time benefits, and thus they provide an easy diagnosis method that differs from the service offered by large hospitals.

Take diabetes mellitus for example. This disease has serious symptoms and poses an increasing threat to human health globally, and therefore associated diagnostic devices are being developed. Presently, most manufacturers are focused on electrochemical biosensor strip. However, electrochemical biosensor strip involves complex processes and requires additional instruments to read the results, thus increasing costs. The need for electricity is another disadvantage of such devices, as it limits device spread in countries or regions that suffer energy shortages.

SUMMARY OF THE INVENTION

One objective of the present invention is to provide a biomedical diagnostic device for detecting the concentration of at least one biomarker in a fluid sample, such as urine glucose, $NO_2^-$, kidney protein, urinary protein, ketone body, bilirubin, uric acid and so on.

Additionally, the present invention aims to provide a biomedical diagnostic device offering high availability, low cost and no electricity consumption.

Furthermore, the present invention aims to provide a biomedical diagnostic device that is easy to operate and can be used at home without special training to obtain a quick diagnosis.

To achieve the above objectives and others, a biomedical diagnostic device comprises a hydrophilic layer, a hydrophobic layer, and at least one test pad. The hydrophilic layer includes an introductory portion exposed to facilitate test fluid entry, and the hydrophobic layer having at least one access hole for accommodating the test pads individually that is stacked with the hydrophilic layer. The test pads contact the hydrophilic layer and each includes a reaction medium. The reaction media may be distinguishable.

The following relation holds in terms of hydrophilicity: any test pad>hydrophilic layer>hydrophobic layer.

The test fluid is introduced and delivered at the introductory portion and eventually reaches and is steadily adsorbed by the pad because of different levels of hydrophilicity. Through the design, multiple-biomarker detection is performed immediately, and the advantages of ease of use, portability, and low cost are realized. The hydrophilic and hydrophobic layers may use cheap fabric such as cotton, cloth or similar.

Other advantages of the present invention include short detection time and the consequent avoidance of mutual contamination between adjacent pads during fluid delivery when using a standard calibration curve method to accurately obtain semi-quantitative concentrations of the test fluid for multiple biomarkers.

The biomedical diagnostic device may further include a housing for fully or partially enclosing the hydrophilic and hydrophobic layers. The portion of the housing that corresponds to the access holes is transparent to enable users to view a change of the pads. In one example, the housing includes a transparent substrate stacked with the hydrophilic layer and a transparent cover stacked with the hydrophobic layer.

One feature of the present invention is that the diagnostic device can be made either flexible or inflexible through appropriate material selection for the hydrophilic layer, hydrophobic layer, and housing.

Numerous possible configurations exist for the hydrophilic and hydrophobic layers. For example, the two layers may combine to form a strip structure, with an introductory portion placed at one terminal end of the hydrophilic layer, or the two layers may combine to form a branch structure such as a cross or X type, with an introductory portion disposed at a bifurcation of the branch structure, or alternatively, the two layers may combine to form a circular disk structure with an introductory portion at its center.

In the case of the branch structure, plural branch members may be included, and a shrunk width of a path between a bifurcation and any access hole is shown from a top view.

A portion of at least one of the plural test pads contacts the outer surface of the hydrophobic layer while the other portion contacts the hydrophilic layer so that the hydrophilic layer is partially exposed from the access holes.

BRIEF DESCRIPTION OF THE DRAWINGS

The objectives and advantages of the present invention will become apparent upon reading the following description and referring to the accompanying drawings as follows.

DESCRIPTION OF THE PREFERRED EMBODIMENT

Figure 1:
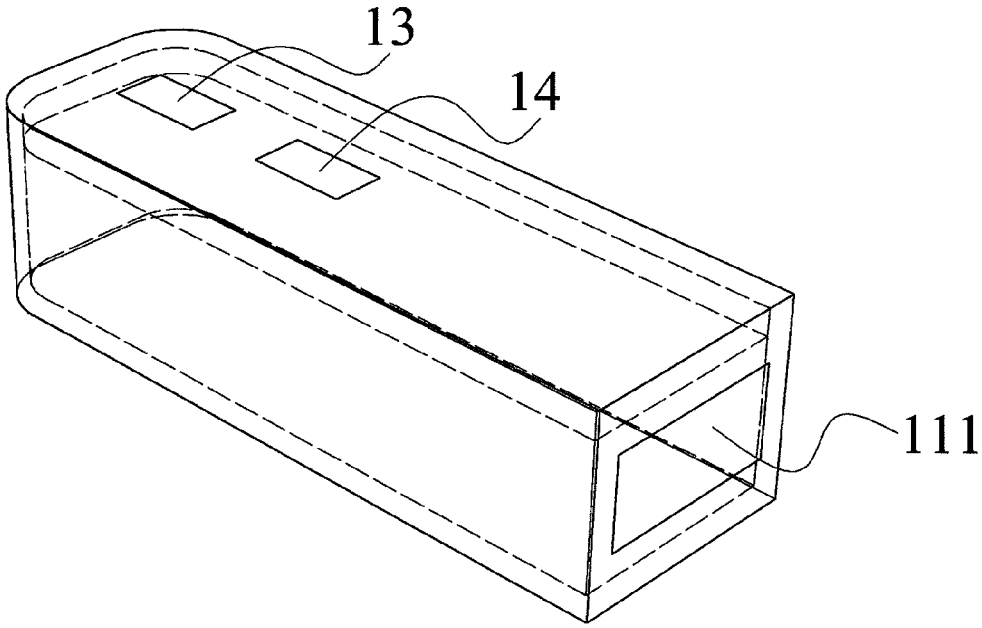
FIG. 1 shows a perspective view of a biomedical diagnostic device according to the first embodiment of the present invention.
Figure 2:
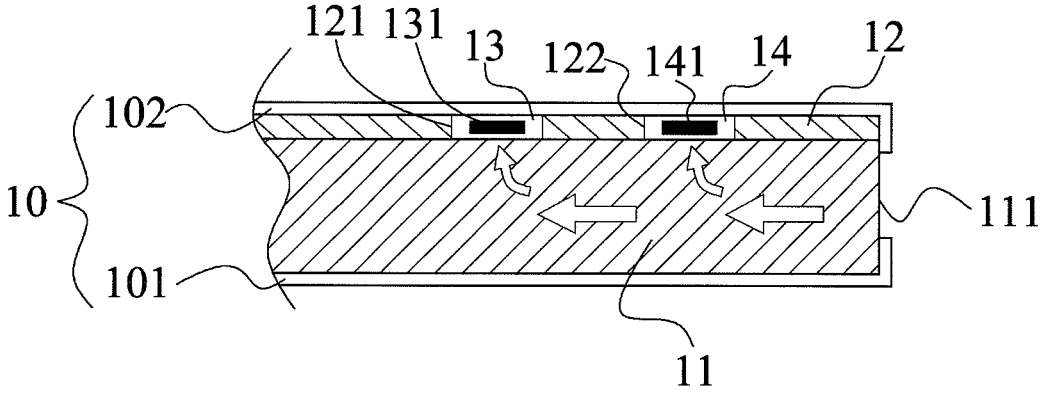
FIG. 2 illustrates a longitudinal cross sectional view of the biomedical diagnostic device according to the first embodiment of the present invention.

FIG. 1 shows a perspective view of a biomedical diagnostic device according to a first embodiment of the present invention, and FIG. 2 shows a longitudinal cross sectional view of the biomedical diagnostic device according to a first embodiment of the present invention; this example shows that a biomedical diagnostic device mainly includes a hydrophilic layer 11, a hydrophobic layer 12, two test pads 13 and 14, and a housing 10 for enclosing the above elements. This embodiment features a strip type biomedical diagnostic device.

The housing 10 primarily includes a transparent substrate 101 and a transparent cover 102. The hydrophilic layer 11 and the hydrophobic layer 12, which take the form of strips and made of fabric material, are stacked together where the hydrophilic layer 11 has an exposed introductory portion 111 at its terminal end and the hydrophobic layer 12 has two separate access holes 121 and 122. The test pads 13 and 14 are located within the access holes 121 and 122, respectively, and extend to contact the hydrophilic layer 11 with each test pad, including individual reaction media 131 and 141, such as enzymes. In the case of the detection of multiple and different biomarkers, reaction media are selected for distinguishing individual biomarkers. The example involves preparing two pads to detect urine glucose and urine protein.

The transparent substrate 101 is attached to one side of the hydrophilic layer 11 while the transparent cover 102 is attached to one side of the hydrophobic layer 12, thus enclosing the two layers and leaving the introductory portion 111 exposed for test fluid entry. The transparent cover 102 has two transparent portions corresponding to access holes 121 and 122 to facilitate user visibility.

Particularly, in the present invention, in terms of hydrophility, the following relation exists: any test pad>the hydrophilic layer>the hydrophobic layer. Additionally, generally the hydrophility of the housing is less than all the above elements. Hydrophility can be determined using various methods such as the best known "contact angle measurement".

In using the above biomedical diagnostic device, a test fluid such as blood or urine is introduced at the introductory portion 111 of the hydrophilic layer 11. Based on the lateral flow principle, the fluid diffuses forwards along a fluid channel comprising the hydrophilic layer 11, as shown in the arrows in the figure. Upon reaching the first test pad 14, the fluid flows in because of hydrophility difference, and specific ingredients in the fluid begin to react with the reaction medium 141 of pad 14, eventually displaying a result reading based on color. The user can view the result through access hole 122.

The remainder of the test fluid flows into the next test pad 13 owing to the same hydrophility difference. Specific ingredients in the fluid react with medium 131 of pad 13, and a result is displayed which can also be read based on color. The user views the result through access hole 121.

Notably, because of the test pads 13 and 14 being separated by the hydrophobic layer material, and the impossibility of the fluid flowing back through the hydrophilic layer given hydrophility difference, mutual contamination is largely prevented, enabling an accurate result to be obtained. Additionally, water in the fluid can be effectively conserved in the hydrophilic layer so that delivery involves only minor variation of fluid concentration and semi-quantitative concentration of the fluid can be evaluated accurately using the standard calibration curve method. However, various detection tasks involve individual unique standard curves, and therefore a distance between the test pads 13 and 14 accommodated in access holes 121 and 131 and the introductory portion 111 indirectly influences the accuracy of the quantitative analysis (the detection concentration must lie in the standard curve).

In the embodiment the housing is made of transparent plastic material, and cotton is selected for the hydrophilic and hydrophobic layers so that the entire device is flexible.

A common conventional diagnostic device is an electrochemical sensing device requiring a conductive film or a chip, which involves a complex and expensive manufacturing process that requires electricity. In contrast, the present biomedical diagnostic device has numerous advantages: it has a simple configuration; the main components, namely the hydrophilic and hydrophobic layers, are made from materials with high availability and low cost, such as cotton; it requires no electrode and micro fluid channels existing in prior art; it is convenient to operate and requires no specialized kit or electricity; it is light weight, compact, and portable; it has multiple functions allowing for simultaneous detection of various biomarkers, meaning there is no need to pay for individual detections. These advantages help minimize costs and allow countries or areas suffering resource shortages or economic weakness to afford point of care diagnosis, and thus they help public health.

Figure 3:
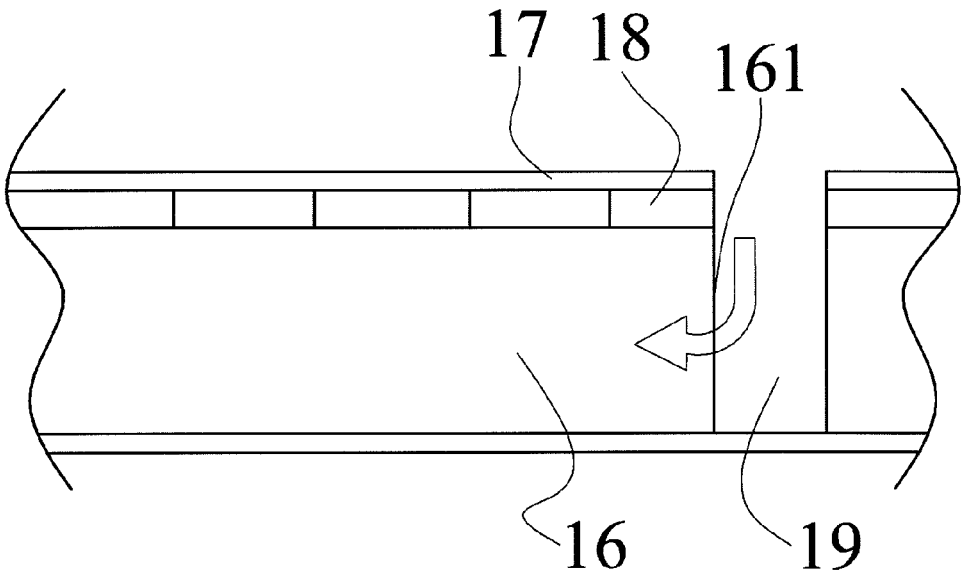
FIG. 3 shows a longitudinal cross sectional view of a biomedical diagnostic device according to the second embodiment of the present invention.

Referring to FIG. 3, a longitudinal cross sectional view of a biomedical diagnostic device according to a second embodiment of the present invention; in this embodiment the biomedical diagnostic device has a similar configuration to that described above except for an introductory portion located in the middle of the hydrophilic layer rather than at a terminal end. Specifically, by vertically digging a hydrophilic layer 16, a top cover 17, and a hydrophobic layer 18, an indentation 19 is provided to externally expose a portion of the hydrophilic layer 16, providing an introductory portion 161.

The introductory portion thus can be set anywhere.

Figure 4:
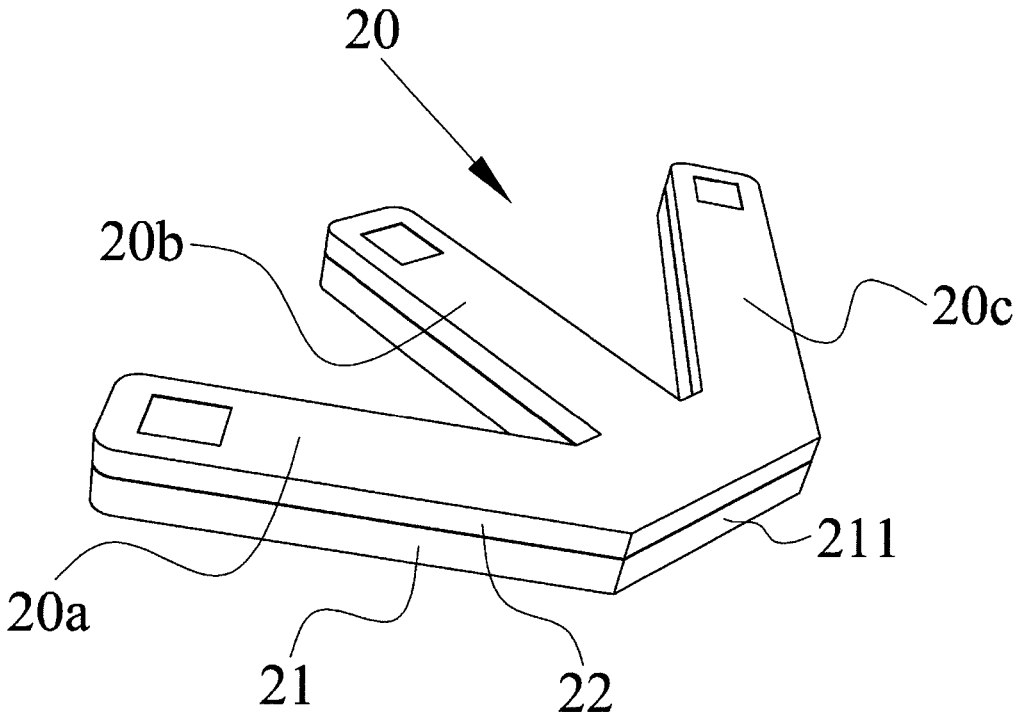
FIG. 4 shows a perspective view of a biomedical diagnostic device according to the third embodiment of the present invention.

From FIG. 4, a perspective view of a biomedical diagnostic device according to a third embodiment of the present invention; the embodiment shares the same stacked structure as the first embodiment, and related features are omitted for simplicity. This example focuses on a branch structure 20 formed by a combination of a hydrophilic layer 21 and hydrophobic layer 22, such as a device with a radiated three-forked configuration as shown in the figure. In the device, an introductory portion 211 is disposed at a bifurcation of the branch structure 20, and also at a lateral face of hydrophilic layer 21. The branch structure 20 includes three branch members 20*a* through 20*c*, extending outwardly and radially from the bifurcation. The lengths of the branch members can vary as required; for example, two of the branch members 20*a* and 20*b* have identical length that exceeds that of 20*c*. In this example, three test pads are prepared to detect urine glucose, urine acid, and urine protein.

Figure 5:
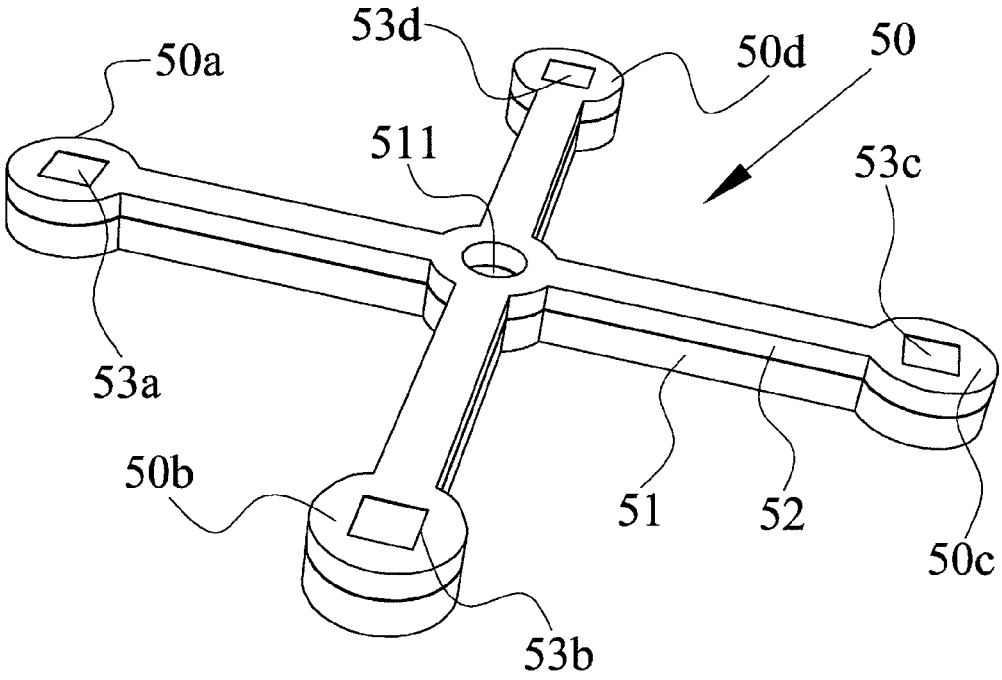
FIG. 5 shows a perspective view of a biomedical diagnostic device according to the fourth embodiment of the present invention.

FIG. 5 shows a perspective view of a biomedical diagnostic device according to a fourth embodiment of the present invention, which resembles the third embodiment in that a hydrophilic layer 51 and a hydrophobic layer 52 combine to form a branch structure 50, with an exception that structure 50 is an X type structure. An introductory portion 511 is arranged at a bifurcation of the branch structure 50 as the previous embodiment (it is also a center of the whole structure, as observed from a top view) but is situated in the middle of the hydrophilic layer 51 instead of on a lateral face. The branch structure 50 includes four branch members 50*a* through 50*d* that extend outward from the bifurcation.

Particularly, branch structure 50 is designed such that the path width between the bifurcation and individual access holes 53*a* through 53*d* shrinks by a constant amount, when observed from above. Therefore, a specific amount of test fluid is ensured to be sufficient to enter each branch member, preventing fluid from entering only some members.

Figure 6:
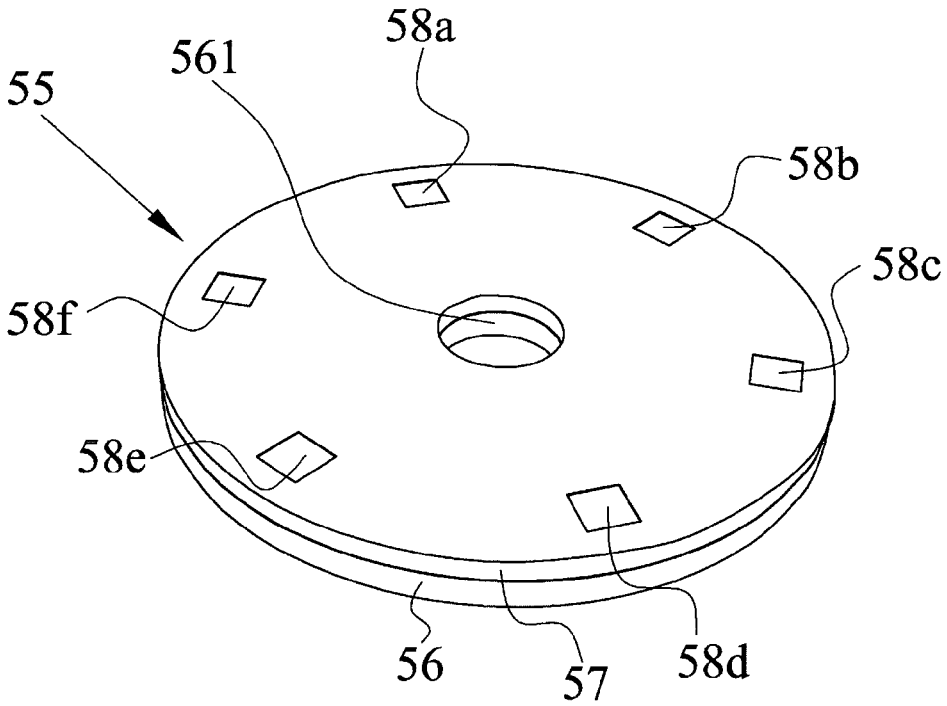
FIG. 6 illustrates a perspective view of a biomedical diagnostic device according to the fifth embodiment of the present invention.

FIG. 6 shows a perspective view of a biomedical diagnostic device according to a fifth embodiment of the present invention; this example has the same stacked configuration as the first embodiment and displays a circular disk structure formed by a combination of a hydrophilic layer 56 and a hydrophobic layer 57, and multiple access holes 58*a* through 58*f* may be arranged at identical or varied angles. An introductory portion 561 is located in the middle of hydrophilic layer 56.

Figure 7:
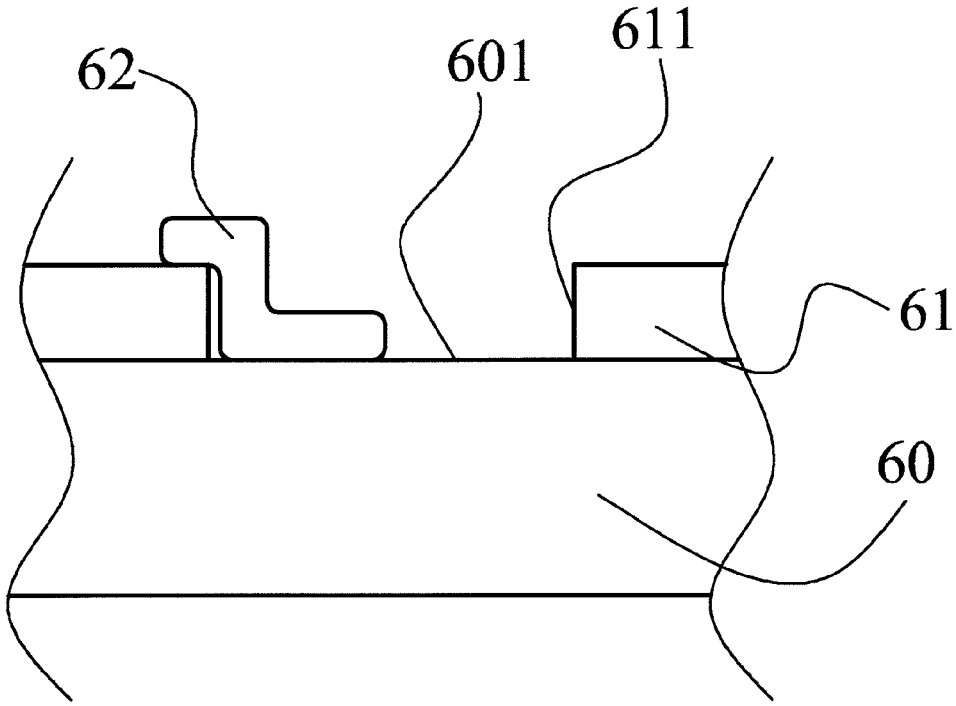
FIG. 7 shows a longitudinal cross sectional view of a biomedical diagnostic device according to the sixth embodiment of the present invention.

FIG. 7 shows a longitudinal cross section of a biomedical diagnostic device according to the sixth embodiment of the present invention; a test pad 62 is shown partially contacting an outer surface of the hydrophobic layer 61 and bendingly extending through access hole 611 to the hydrophilic layer 60. A portion of the hydrophilic layer 60 is exposed from access hole 611 as pad 62 only partially covers the access hole 611, thus revealing exposed zone 601. This structure helps avoid saturation of the test pad absorbing the test fluid resulting from return percolation and consequent contamination.

What is claimed is:

1. A biomedical diagnostic device, comprising:

a hydrophilic layer comprising an exposed introductory portion for entry of a test fluid;

a hydrophobic layer stacked with the hydrophilic layer and comprising at least one access hole; and at least one test pad accommodated in the at least one access hole and contacting with the hydrophilic layer, each test pad comprising a reaction medium and any of the reaction media being distinguished from one another;

wherein a relation below is followed: a hydrophilicity of any test pad>a hydrophilicity of the hydrophilic layer>a hydrophilicity of the hydrophobic layer.

2. The biomedical diagnostic device of claim 1, wherein a portion of the at least one test pad contacts with an outer surface of the hydrophobic layer and the other portion with the hydrophilic layer so that the hydrophilic layer is exposed partially from the at lest one access hole.

3. The biomedical diagnostic device of claim 2, further comprising a housing, the housing comprising a transparent substrate stacked with the hydrophilic layer and a transparent cover stacked with the hydrophobic layer.

4. The biomedical diagnostic device of claim 3, wherein the housing is flexible.

5. The biomedical diagnostic device of claim 1, wherein the hydrophilic layer and the hydrophobic layer combine to form a strip structure with the introductory portion disposed at one terminal end of the hydrophilic layer.

6. The biomedical diagnostic device of claim 1, wherein the hydrophilic layer and the hydrophobic layer combine to form a branch structure with the introductory portion disposed at a bifurcation of the branch structure.

7. The biomedical diagnostic device of claim 6, wherein the branch structure comprises plural branch members and a width of a path between the bifurcation and any access hole is shaped to be shrunk from a top view.

8. The biomedical diagnostic device of claim 6, wherein the branch structure is referred to an X type structure with the introductory portion disposed at a center of the X type structure.

9. The biomedical diagnostic device of claim 1, wherein the hydrophilic layer and the hydrophobic layer combine to form a circular disk structure with the introductory portion disposed at a center of the circular disk structure.

10. The biomedical diagnostic device of claim 1, wherein at least one of the hydrophilic layer and the hydrophobic layer is made of cotton.

* * * * *